US007677295B2

(12) United States Patent
Fulton et al.

(10) Patent No.: US 7,677,295 B2
(45) **Date of Patent: *Mar. 16, 2010**

(54) DIE CASTING PROCESS INCORPORATING COMPUTERIZED PATTERN RECOGNITION TECHNIQUES

(75) Inventors: Arnie Fulton, Fayetteville, AR (US); Yan Zhu, Fayetteville, AR (US); Michael Bomar, Ozark, AR (US)

(73) Assignee: Pace Industries, LLC, Fayetteville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/049,057

(22) Filed: Mar. 14, 2008

(65) Prior Publication Data

US 2008/0156451 A1 Jul. 3, 2008

Related U.S. Application Data

(63) Continuation of application No. 10/887,767, filed on Jul. 9, 2004, now Pat. No. 7,363,957, which is a continuation of application No. 10/208,416, filed on Jul. 30, 2002, now Pat. No. 6,776,212.

(60) Provisional application No. 60/390,779, filed on Jun. 21, 2002.

(51) Int. Cl.
*B22D 46/00* (2006.01)

(52) U.S. Cl. ..... 164/4.1; 164/154.1

(58) Field of Classification Search ..... 164/4.1, 164/154.1, 150.1
See application file for complete search history.

(56) References Cited

U.S. PATENT DOCUMENTS

| | | | | |
|---|---|---|---|---|
| 5,841,669 | A | 11/1998 | Purvis et al. | |
| 5,894,005 | A * | 4/1999 | Steel et al. | 264/40.1 |
| 6,772,821 | B1 | 8/2004 | Fulton et al. | |
| 6,776,212 | B1 * | 8/2004 | Fulton et al. | 164/4.1 |
| 6,779,583 | B1 * | 8/2004 | Fulton et al. | 164/4.1 |
| 7,363,957 | B2 * | 4/2008 | Fulton et al. | 164/4.1 |

* cited by examiner

*Primary Examiner*—Kevin P Kerns
(74) *Attorney, Agent, or Firm*—Conley Rose, P.C.; Kristin Jordan Harkins

(57) ABSTRACT

A die casting process using pattern recognition techniques to identify those die castings manufactured under conditions likely to produce a die casting which would subsequently prove unacceptable for use. By promptly identifying such die castings, they may be discarded before being shipped to a remote facility for further processing. As a result, the rejection rate of die castings at the remote facility may be reduced and the raw materials used to form the discarded die castings may be more readily recycled.

8 Claims, 8 Drawing Sheets

DIE CASTING PROCESS INCORPORATING COMPUTERIZED PATTERN RECOGNITION TECHNIQUES

CROSS-REFERENCE TO RELATED APPLICATIONS

This application is a Continuation of and claims benefit under 35 USC §120 to 10/887,767 now U.S. Pat. No. 7,363,957 entitled "Die Casting Process Incorporating Computerized Pattern Recognition Techniques" filed Jul. 9, 2004, which is a Continuation of and claims benefit under 35 USC §120 to 10/208,416 now U.S. Pat. No. 6,776,212 entitled "Die Casting Process Incorporating Computerized Pattern Recognition Techniques," filed Jul. 30, 2002, which, in turn, was related to and claims benefit under 35 USC §119 to U.S. Provisional Patent Application Ser. No. 60/390,779, filed Jun. 21, 2002, all of which are assigned to the Assignee of the present application and hereby incorporated by reference as if reproduced in their entirety.

This application is also related to U.S. Pat. No. 6,779,583 entitled "Die Casting Process Iterative Process Parameter Adjustments" and U.S. Pat. No. 6,772,821 entitled "System for Manufacturing Die Castings," both of which were filed on Jul. 30, 2002 and are assigned to the Assignee of the present application and are hereby incorporated by reference as if reproduced in their entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The invention is directed to die casting processes and, more particularly, to die casting processes which use pattern recognition techniques to identify those die castings manufactured under conditions likely to produce a die casting which subsequently proves to be unacceptable for use. By promptly identifying such die castings, they may be discarded before being shipped to a remote facility for further processing. As a result, the rejection rate of die castings at the remote facility may be reduced. Further, the raw materials used to form the discarded die castings may be more readily recycled.

BACKGROUND OF THE INVENTION

Generally, die castings are produced by forcing a molten metal under pressure into a steel die and maintaining the molten metal under pressure until solidification of the molten metal into a casting is complete. A wide variety of metal and metal alloys may be used in die casting processes. For example, aluminum alloys, brass alloys and zinc alloys are all commonly used in die casting processes to form die castings. Broadly speaking, a die casting process requires the following elements: (a) a die-casting machine to hold a molten metal or metal alloy under pressure; (b) a metallic mold or die capable of receiving the molten metal or metal alloy and designed to permit easy and economical ejection of the solidified metal or metal alloy die casting; and (c) a metal or metal alloy which, when solidified into a metal or metal alloy die casting, will produce a satisfactory product with suitable physical characteristics.

There are two types of die-casting machines commonly in use today. The first, or cold-chambered, die-casting machine forces the molten metal or metal alloy into the die by means of a plunger and chamber located outside the molten metal or metal alloy bath. Conversely, the second, or hot-chamber, die-casting machine forces the molten metal or metal alloy into the die by means of a plunger and chamber which are submerged in the molten metal or metal alloy bath. Depending on the production requirements therefore, the metallic mold or dies to be used in die casting processes may be constructed in different styles. A "single" die contains an impression of only one part; a "combination" die contains an impression of multiple parts; a "multiple" die contains two or more impressions of a single part; and a "combination-multiple" die contains a number of impressions of each one of two or more parts. Single dies are comparatively cheap and, since they reduce the tool investment to a minimum for any one part, are typically used for small lot productions. When properly designed, combination dies will reduce the total die cost for a given set of die castings to a minimum. They are particularly useful for die castings that will always be used in the same quantities and formed of the same alloy. Multiple dies are usually slower to operate than single dies but will give higher production rates for the same labor costs.

It should be readily appreciated that a wide variety of die castings may be produced by application of conventional die casting manufacturing principles. One such die casting is an aluminum alloy die casting. Similarly, while aluminum alloy die castings may be used in a wide variety of applications, in one such application, specially shaped aluminum alloy die castings are used as the rocker cover and the rocker housing for the FL Series motorcycle currently manufactured by the Harley-Davidson Motor Company of Milwaukee, Wis. To enhance the appearance thereof, prior to mounting of the rocker cover and rocker housing die castings on the FL Series motorcycle, the aluminum alloy die castings are plated with chromium. Traditionally, the aluminum alloy die castings have been manufactured at a first facility and subsequently shipped to a second facility for plating.

A drawback to this process has been that, once subjected to the chrome-plating process, the aluminum alloy die castings produced at the first facility often proved unsuitable for their intended later use. For example, using conventional die casting techniques, chrome-plated aluminum alloy die castings to be used as either a rocker cover or rocker housing for the aforementioned FL Series motorcycles were experiencing a rejection rate of about 40% due to defects noted during inspections of the die castings conducted during and/or after the chrome-plating process. While the rejection rate has been attributed to a variety of causes, one such cause is that a number of the various types of defects which commonly occur during the manufacture of an aluminum alloy die casting can remain unnoticed until after an attempt has been made to chrome-plate the die casting.

It should be readily appreciated that a rejection rate of about 40% adds considerably to the cost of chrome-plated aluminum alloy rocker covers or chrome-plated aluminum alloy rocker housings. It should also be readily appreciated that substantial cost savings may be achieved by reducing the rejection rate of chrome-plated aluminum alloy rocker covers, chrome-plated aluminum alloy rocker housings and other products manufactured using die casting processes which are currently plagued by high rejection rates. Achieving a reduction in such rejection rates is, therefore, an object of the present invention.

SUMMARY OF THE INVENTION

In one embodiment, the present invention is directed to a method for manufacturing castings by first selecting a set of conditions and subsequently manufacturing at least one casting under the selected set of conditions. Any casting manufactured under actual conditions which vary from the selected set of conditions is discarded. In one aspect, a profile is constructed for each casting manufactured under the selected set of conditions and, if the profile for a casting manufactured under the selected set of conditions matches any one of at least one defective casting profile, the casting corresponding to the constructed profile is discarded.

Each one of the selected set of conditions may be comprised of a pre-selected level for a pre-specified physical parameter and a profile for a casting manufactured under the selected set of conditions may be comprised of a unique identifier assigned to that casting and an actual level for each of the physical parameters which is measured during the manufacture thereof. Variously, the unique identifier may include the date of manufacture, shot number and/or die cast machine number while the set of physical parameters may include cavity pressure, die temperature, at least one die lubricant data component, at least one shot parameter, metal chemistry and metal temperature.

In another embodiment, the present invention is directed to a method for manufacturing castings, in accordance with which, a set of conditions, each comprised of a pre-selected level for a pre-specified physical parameter is selected. A first plurality of castings are then manufactured, at a manufacturing facility, under the selected set of conditions. The first plurality of castings are analyzed for defects and a database which includes at least one defective casting profile constructed from the analysis of the first plurality of castings. A second plurality of castings are then manufactured, at the manufacturing facility, under the selected set of conditions. During the manufacture of each casting, an actual level for each one of the physical parameters is measured and each casting for which the measured level of one of the physical parameters matches one of the defective casting profiles of the database is discarded. In one aspect thereof; the discarded castings are those for which the measured levels of the physical parameters match values for the set of conditions of one of the defective casting profiles of the database. In another, the castings to be discarded are identified by comparing, for each defective casting profile, the value of each one of the set of conditions included therein to the measured level of a corresponding one of the physical parameters. If the value of the conditions included in the selected defective profile match the measured levels for the corresponding physical parameters, the casting is discarded. Conversely, if the value of the conditions included in the selected defective profile fail to match the measured levels for the corresponding physical parameters, a subsequent one of the defective casting profiles is selected for examination.

In a further aspect of this embodiment of the invention, each one of the second plurality of castings are marked with a unique identifier. In this aspect, the profiles constructed for each one of the second plurality of castings include the actual level of each one of the physical parameters measure during the manufacture of, and the unique identifier marked on, that casting. Each one of the second plurality of castings may then be analyzed for defects and defect information obtained from the analysis thereof may be included in the profile constructed therefore. The database may be modified to incorporate information derived from the profiles constructed for the second plurality of castings. If so, a third plurality of castings may be manufactured under the selected set of conditions. For each such casting, an actual level for each one of the physical parameters is measured during the manufacture thereof and each casting for which the measured levels of the physical parameters matches a defective casting profile of the modified database is discarded In a still further aspect of this embodiment of the invention, a first portion of the second plurality of castings is selected and at least one test performed thereon at the manufacturing facility. Defect information for those castings is then derived from the performed tests. Variously, the tests may include destructive testing such as blistering tests and/or non-destructive testing such as x-ray tests. The remaining portion of the second plurality of castings is shipped to a processing facility remotely located relative to the manufacturing facility. Defect information for the remaining portion of the second plurality of castings is then derived during the further processing of the castings at the remotely located facility. Thus, in accordance with this aspect of the invention, defect information for the profile of each one of one portion of the second plurality of castings is derived at the manufacturing facility, defect information for the profile of each one of the remaining portion of the second plurality of castings is derived at the remotely located processing facility and the actual level of each one of the physical parameters for the profile of each one of the second plurality of castings is measured at the manufacturing facility.

In still another embodiment, the present invention is directed to a method for manufacturing chrome-plated, metal-alloy castings. In accordance with this method a set of conditions, each comprised of a pre-selected level for a pre-specified physical parameter, are selected and a first plurality of metal-alloy castings are manufactured, at a manufacturing facility, under the selected set of conditions. The first plurality of metal-alloy castings are analyzed for defects and a database is constructed from the analysis of the metal-alloy castings for defects and measurements of physical parameters under which the metal-alloy castings were manufactured. A unique identifier respectively marked on each one of the first plurality of metal-alloy castings is used to associate a defect analysis for the metal-alloy casting with the physical parameter measurements for that metal-alloy casting. The database constructed from the foregoing information includes at least one defective casting profile and at least one suitable casting profile. Subsequent to construction of the database, a second plurality of metal-alloy castings are manufactured, again, at the manufacturing facility, under the selected set of conditions. A casting profile which includes, for each metal-alloy casting, the actual level of each one of the physical parameters measured during the manufacturing thereof and the unique identifier marked thereon is constructed. Each one of the second plurality of metal-alloy castings having a profile which matches one of the at least one defective casting profile maintained in the database is discarded. The undiscarded ones of the second plurality of metal-alloy castings are shipped to a chrome-plating facility, remotely located relative to the metal-alloy manufacturing facility, for chrome-plating. A defect profile containing the unique identifier for a metal-alloy casting and defect information for the metal-alloy casting identified during the chrome-plating process is then constructed for each one of the undiscarded ones of the second plurality of metal-alloy castings. Each one of the constructed defect profiles is associated with a corresponding one of the casting profiles and the database modified to incorporate information derived from the constructed defect profiles and the associated casting profiles.

DETAILED DESCRIPTION OF THE INVENTION

Figure 1:
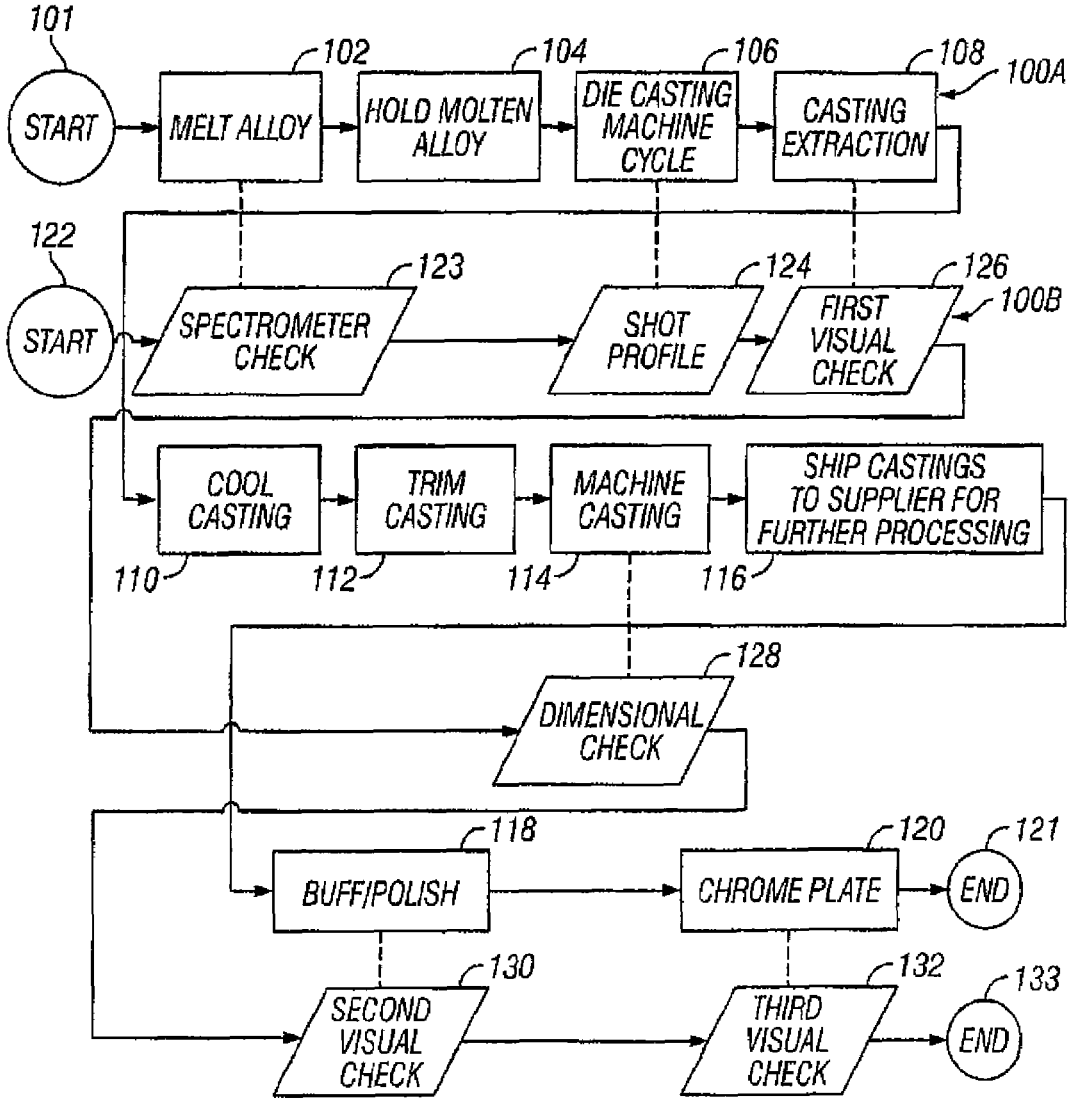
FIG. 1 (PRIOR ART)
FIG. 1 is a block diagram of a conventional process for manufacturing chrome-plated aluminum alloy die castings and an associated conventional process for monitoring the manufacture of the chrome-plated aluminum alloy die castings.

FIG. 1 shows a conventional die casting process 100*a* suitable for use in the manufacture of die castings, for example, chrome-plated aluminum alloy rocker cover and rocker housing die castings. The die casting process 100*a* commences at step 101 and, proceeding on to step 102, a primary furnace or similar heating device is used to melt a metal or metal alloy, for example, an aluminum alloy, by heating an amount of the solid metal or metal alloy to an elevated temperature above its melting point. For example, if an aluminum alloy was to be melted using the primary furnace, a temperature of about 1,300 degrees Fahrenheit would be suitable. Once melted, the molten metal or metal alloy is transported, for example, using a bull ladle, to a secondary furnace or similar heating device where the molten metal or metal alloy is held, at step 104, in advance of initiation of a die cast machine cycle, at step 106, by a die cast machine. Proceeding on to step 106, a die cast machine cycle is initiated by forcing, under pressure, the molten metal or metal alloy into a steel die of the rocker cover, rocker housing or other die casting to be manufactured using the die cast machine. Once injected into the steel die, the molten metal or metal alloy is maintained under pressure until solidification of the die casting is complete. Upon completing the die cast machine cycle, the method proceeds to step 108 where the, now solidified, rocker cover, rocker housing, or other die casting is extracted from the steel die.

Continuing on to step 110, the extracted die casting is cooled, typically, to room temperature and, at step 112, the die casting is trimmed to remove the runners, overflows and biscuit from the die casting. Final machining of the die casting is performed at step 114, thereby making the die casting ready for shipment to the customer, for example, a manufacturer who assembles a product or products which incorporates the manufactured die castings thereinto. It should be noted, however, that the manufacturing chain is quite varied. Accordingly, the customer of manufactured die castings is oftentimes a supplier who further processes the die casting before re-selling the finished product to yet another manufacturer. For example, after aluminum alloy motorcycle rocker cover or rocker housing die castings are manufactured, they are typically shipped to a supplier who chrome-plates the die castings before supplying them to the manufacturer who assembles motorcycles which incorporate the chrome-plated rocker cover or rocker housing die castings.

Accordingly, at step 116, the die castings are shipped to a supplier for further processing of the die castings before delivery to the manufacturer. Typically, the supplier maintains a facility remotely located relative to the facility where the die castings were manufactured. At step 118, the die castings are buffed and polished and, at step 120, the die castings are chrome-plated. The method then ends at step 121 with the chrome-plated die castings ready for sale and/or incorporation into a product for sale. For example, the chrome-plated motorcycle rocker cover or rocker housing die castings are now ready for shipment to a manufacturing facility for incorporation into a motorcycle. Of course, shipping of the die castings to the supplier's facility may be avoided if the final preparatory steps of buffing, polishing and chrome-plating are performed by the manufacturer of the die castings themselves. Further, the sale or incorporation of the die castings into products for sale may also be performed by the manufacturer of the die castings as well.

Traditionally, the die casting process was monitored to a limited degree. As this relatively limited monitoring process 100*b* was performed generally concurrently with the die casting process 100*a*, it is necessary to periodically refer to the die casting process 100*a* while describing the monitoring process 100*b*. The monitoring process 100*b* commences at step 122 and, at step 123, a conventionally configured spectrometer is used to analyze the chemical composition of the molten metal or metal alloy, produced at step 102 of the manufacturing process 100*a*, to be subsequently used to form the die castings. To analyze the molten metal or metal alloy, a spectral analysis is obtained for comparison with a pre-selected baseline spectrum which corresponds to the desired chemical composition. Deviations from the baseline spectrum are indicative that the chemical composition of the molten metal or metal alloy to be used in the die casting process differs from the desired chemical composition thereof.

The segment of a die casting machine cycle in which the molten metal or metal alloy is forced into the steel die is commonly referred to in the art as a "shot" and a set of measured physical parameters under which the shot is conducted is commonly referred to in the art as a "shot profile." While the precise combination of physical parameters included in a shot profile may vary amongst die casting process designers, physical parameters typically selected for inclusion in nearly all shot profiles include slow shot velocity, fast shot velocity, transition time and intensification pressure. The slow shot velocity is the speed of the molten metal or metal alloy entering a slot sleeve of the die casting machine. The fast shot velocity is the speed of the molten metal being injected into the steel die itself. The transition time is the time delay between the slow shot and fast shot portions of the die casting machine cycle. Finally, the intensification pressure is a measure of the pressure at the end of die filling. Thus, at step 124 of the monitoring process 10*b*, as the shot segment of the die casting machine cycle is executed as part of step 106 of the manufacturing process 100*a*, a shot profile for the shot is acquired, typically, using one or more sensors positioned at appropriate locations within the die casting machine.

The monitoring process 100*b* then proceeds to step 126 where, upon extraction of the die castings from the die cast machine at step 108 of the manufacturing process 100*a*, the die castings are examined for visible surface defects such as pitting during a first visual inspection thereof. Continuing on to step 128 of the monitoring process 100*b*, after machining of the die casting is completed at step 114 of the manufacturing process 100*a*, the dimensions of the machined die casting are measured to ensure that the dimensions of the machined die casting matches the intended dimensions thereof (within appropriate pre-selected tolerances therefore). Presuming that the die casting passes the first visual inspection for defects conducted at step 126 and the dimensions of the die casting were determined at step 128 to be within the predetermined tolerances therefore, the die casting would now be considered ready for shipping to the supplier.

Monitoring of the die casting manufacturing process 100*a* continues at the supplier's facility. At step 130 of the monitoring process 100*b*, after the die castings are buffed and polished at step 118 of the manufacturing process 100*a* in preparation for plating, the die castings are examined for visible defects during a second visual inspection. Any noted defects are reported back to the manufacturer and the die castings containing the noted defects are rejected by the supplier. Proceeding on to step 132 of the monitoring process 100*b*, after the die castings have been chrome-plated at step 120 of the manufacturing process 100*a*, the die castings are again examined for visible defects during a third visual inspection. As before, any noted defects are reported back to the manufacturer and the die castings containing the noted defects are rejected by the supplier. Monitoring of the die casting manufacturing process then ends at step 133.

The monitoring process 100*b* provides a very limited amount of information suitable for use in improving the quality of subsequent die castings manufactured by the monitored die casting process 100*a*. Prior to manufacture of the die castings, a desired chemical composition for the metal or metal alloy and a desired shot profile are selected. Typically, a process designer employed by the manufacturer selects values for these physical parameters as those values which are believed to minimize the likelihood that die castings, manufactured under those physical parameters, would contain defects. Thus, deviations from the selected values for these physical parameters are deemed as increasingly the likelihood that die castings manufactured under such conditions are more likely to contain defects.

The spectrometer check performed at step 123 provides information regarding the chemical composition of the molten alloy. By comparing data acquired during the spectrometer check to the pre-selected desired chemical composition, the manufacturer can determine whether there have been any deviations from the pre-selected chemical composition. Accordingly, information acquired during the spectrometer check may be used to adjust the physical characteristics of the molten alloy being produced at step 102, thereby reducing the likelihood that subsequently manufactured die castings would contain defects. Similarly, the shot profile acquired at step 124 provides a series of measurements of physical parameters under which die castings are manufactured using the die cast machine. By comparing the shot profile acquired at step 124 during the manufacture of one or more die castings to the desired shot profile, the manufacturer can again determine if there have been any deviations in the shot profile under which the die castings are being manufactured. Then, by adjusting the operating parameters for the die cast machine in response to identified deviations in the shot profile, the manufacturer can reduce the likelihood that subsequently manufactured die castings will contain defects.

Defects noted during the various visual inspections of the die castings during the manufacturing process 100*a*, specifically, the first, second and third visual inspections of the die castings conducted at steps 126, 130 and 132 of the monitoring process 100*b*, respectively, are not particularly useful in determining how to adjust the die casting manufacturing process 100*a* in order to reduce the occurrence of defects in subsequently manufactured die castings. The chemical composition and shot profile are all "real-time" measurements for which deviations may be readily identified and corrective action initiated to return the chemical composition and/or shot profile to the pre-selected values. In contrast, the ability of a manufacturer to analyze detected defects in die castings and modify the physical conditions under which subsequent die castings are manufactured based upon such analysis has been limited by several factors. First, defects in die castings cannot be directly linked to any particular physical parameter under which the die castings were manufactured. Accordingly, if the manufacturer has detected a type of defect occurring in the die castings being manufactured, the manufacturer is oftentimes unable to identify which physical parameter should be adjusted to lower the occurrence of such defects. Second, once manufactured, one die casting is virtually indistinguishable from another. As a result, the manufacturer cannot associate a die casting with the physical parameters under which it was manufactured. This, too, greatly weakens the ability of the manufacturer to identify the physical parameters which require adjustment.

Figure 2:
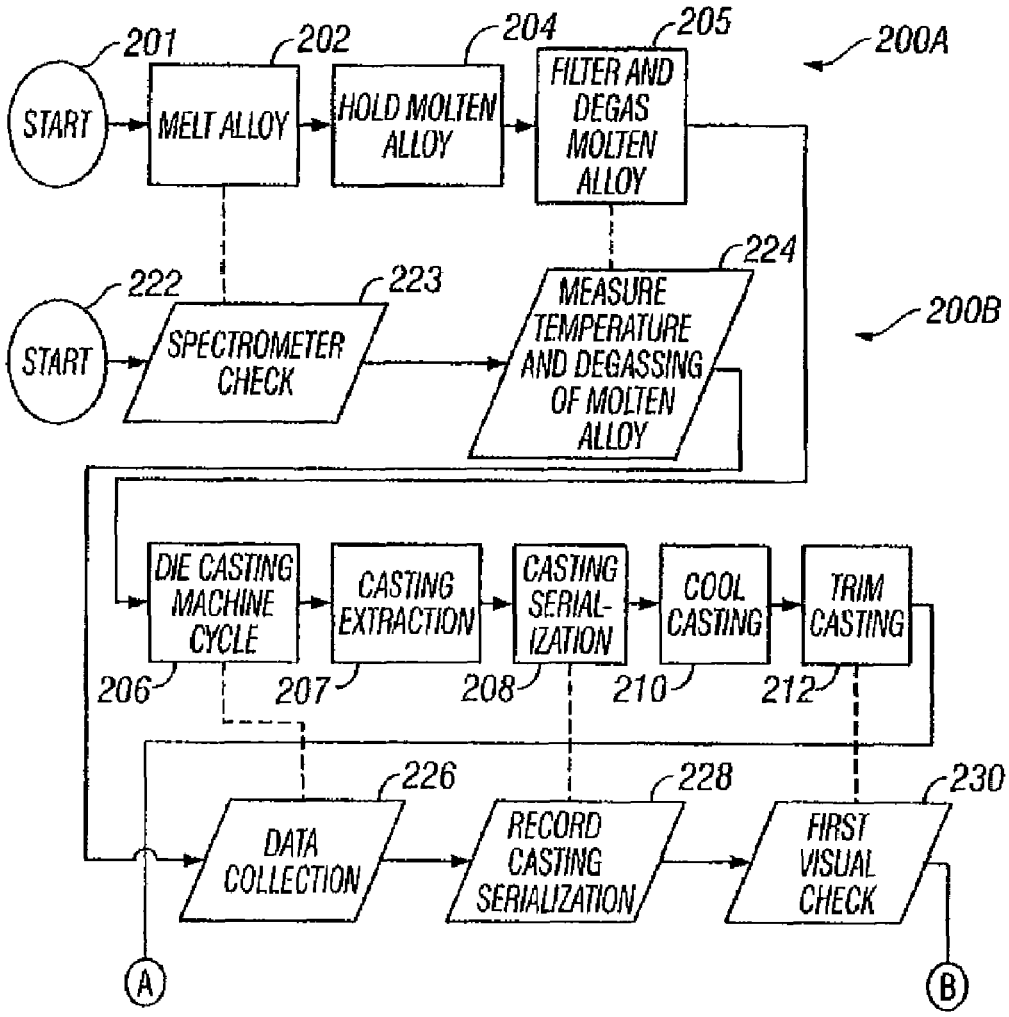
FIG. 2 is a block diagram of a process for manufacturing chrome-plated aluminum alloy die castings and an associated process for monitoring the manufacture of the chrome-plated aluminum alloy die castings in accordance with the teachings of the present invention.
Figure 2:
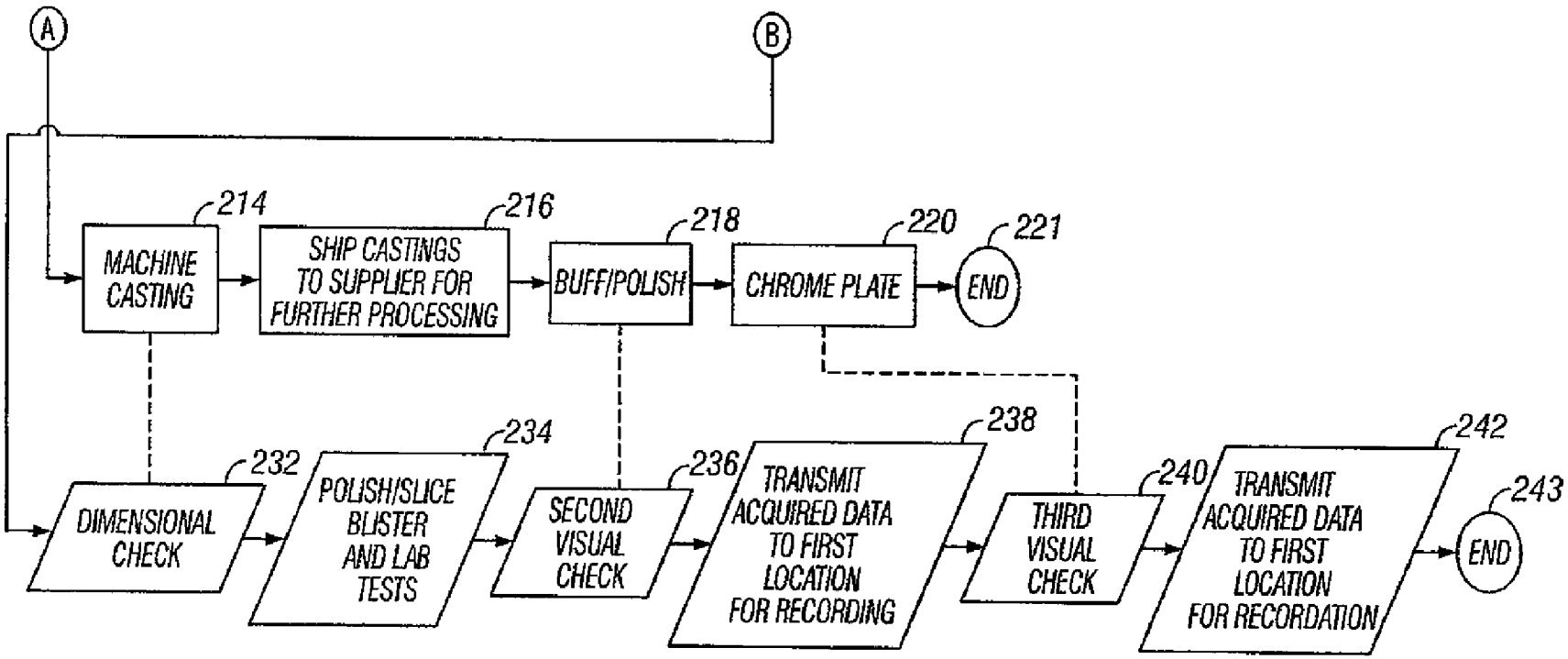

FIG. 2 shows a process 200*a* for manufacturing die castings, for example, chrome-plated aluminum alloy die castings, and an associated process 200*b* for monitoring the manufacture of die casts, again, for example, chrome-plated aluminum alloy die castings, in accordance with the teachings of the present invention. The die casting manufacturing process 200*a* commences at step 201 and, proceeding on to step 202, a primary furnace or similar heating device is used to melt a metal or metal alloy, for example, an aluminum alloy, by heating an amount, typically, about 20,000 pounds, of the solid metal or metal allow to a temperature above its melting point. For example, if an aluminum alloy was to be melted using the primary furnace, a temperature of about 1,300 degrees Fahrenheit would be suitable. Once melted, the molten metal or metal alloy is transported, for example, using a bull ladle, from the primary furnace to a secondary furnace or similar device where a lesser amount, typically, about 2,000 pounds, of the molten metal or metal alloy is temporarily held at step 204.

The secondary furnace holds the molten metal or metal alloy at a temperature which exceeds the melting point thereof. For example, if the secondary furnace is holding molten aluminum alloy, a temperature in the range of about 1,250 to 1,270 degrees Fahrenheit would be suitable. At step 205, the molten metal or metal alloy being held at the secondary furnace is filtered to remove particulate matter such as dirt or other impurities typically introduced into the molten metal or metal alloy during transport to the secondary furnace. Also at step 205, the molten metal or metal alloy is degassed by introducing argon to the molten metal or metal alloy in the form of fine bubbles. As the argon bubbles rise through the molten metal or metal alloy, the argon degasifies the molten metal or metal alloy by removing hydrogen gas, as well as any remaining dirt or other impurities, from the molten metal or metal alloy.

Continuing on to step 206 of the die casting manufacturing process 200*a*, a die casting machine cycle is initiated by forcing, under pressure, the molten metal or metal alloy held in the secondary furnace into a steel die of the rocker cover, rocker housing or other die casting to be manufactured using the die casting machine. Once injected into the steel die, the molten metal or metal alloy is maintained under pressure until solidification of the die casting is complete. Upon completing the die casting machine cycle, the die casting manufacturing process 200*a* proceeds to step 207 where the, now solidified, rocker cover, rocker housing, or other die casting is extracted from the steel die. Upon extraction of the die casting from the steel die of the die casting machine, the rocker cover, rocker housing or other die casting is serialized (step 208) by marking the extracted casting with a unique identifier. For example, the unique identifier may be stamped into a selected location on the die casting, preferably, a location not readily visible upon incorporation of the die casting into the intended finished product. One suitable stamping technique, commonly referred to in the art as "pin stamping", involves forming a series of indentations in the die casting in a pre-determined pattern. Of course, pin stamping is but one example of a suitable marking technique and it is fully contemplated that other marking techniques may also be suitable for the uses contemplated herein.

It is further contemplated that various markings may be used to uniquely identify each die casting formed during a respective cycle of the die casting machine. For example, each die casting may be marked with the month, day and year of manufacture, for example in a "mm/dd/yy" arrangement, and a serial number uniquely identifying the die casting by the shot number of the shot of molten metal or metal alloy from which that die casting was formed. For example, when a steel die is placed in service, the first die casting manufactured using the steel die may be marked with serial number "00001" to indicate that the die casting was the first one manufactured after placing the steel die into service. Each subsequent die casting manufactured using the steel die may then be marked with a serial number generated by incrementing the prior serial number by one. While the serial number assigned to each die casting may, of course, have any number of digits, the use of a five digit number has proven suitable for the uses disclosed herein since it is contemplated that steel dies used in this process tend to have life spans which range between 50,000 and 75,000 shots.

It should be noted, however, that, if the manufacturer maintains a record of the shot numbers used on each day of operation to form die castings, the manufacturer will be able to readily identify the date of manufacture of any particular die casting from the shot number marked thereon upon referencing the aforementioned record of shot numbers used on each day. Accordingly, it is contemplated that, in an alternate embodiment of the invention, the marking used to uniquely identify each die casting need only include the serial number of the die casting.

The foregoing technique for identifying each die casting by uniquely stamping or otherwise marking each such die casting with a serial number, either alone or in combination with a date of manufacture, presumed that the manufacturer employs only a single die casting machine at their facility to form all of the die castings manufactured thereby. However, many manufacturers commonly employ plural die casting machines at a facility, particularly when a relatively high volume of die castings are to be produced. When multiple die casting machines are to be employed at the facility, it is contemplated that the marking uniquely identifying each die casting should further include an indicator of which die casting machine was used to manufacture that particular die casting. For example, if a manufacturer employed four die castings machines to manufacture a particular die casting, the use of a two digit code would be suitable for uniquely identifying the specific die casting machine which manufactured each particular die casting.

Continuing on to step 210 of the manufacturing process 200*a*, the now uniquely identifiable die casting is cooled, typically, to room temperature and, at step 212, the die casting is trimmed to remove the runners, overflows and biscuit from the die casting. Final machining of the die casting is performed at step 214, thereby making the die casting ready for shipment to the customer, for example a manufacturer who assembles a product or products which incorporates the manufactured die castings thereinto. As previously set forth, the manufacturing chain is quite varied. Accordingly, the customer of manufactured die castings is oftentimes a supplier who further processes the die castings before re-selling the finished product to yet another manufacturer. For example, after aluminum alloy motorcycle rocker cover or motorcycle rocker housing die castings are manufactured, they are typically shipped to supplier who chrome-plates the die castings before supplying them to the manufacturer who assembles motorcycles which incorporate the chrome-plated rocker cover or rocker housing die castings.

Accordingly, at step 216, the die castings are shipped to a supplier for further processing of the die castings before delivery to their final destination. Typically, the supplier maintains a facility remotely located relative to the facility where the die castings were manufactured. At step 218, the die castings are buffed and polished and, at step 220, the die castings are chrome-plated. The method then ends at step 221 with the die castings ready for sale and/or incorporation into a product for sale. For example, the chrome-plated motorcycle rocker cover or rocker housing die castings are now ready for shipment to a manufacturing facility for incorporation into a motorcycle. Of course, shipping of the die castings to the supplier's facility may be avoided if the final preparatory steps of buffing, polishing and chrome-plating are performed by the manufacturer of the die castings themselves. Further, the sale or incorporation of the die castings into products for sale may also be performed by the manufacturer of the die castings as well.

Like the die casting manufacturing process 100*a*, the die casting manufacturing process 200*a* is also monitored, here by the monitoring process 200*b*. Again, as the monitoring process 200*b* is performed generally concurrently with the die casting manufacturing process 200*a*, it is again necessary to periodically refer to the die casting manufacturing process 200*a* while describing the monitoring process 200*b*. It should be noted, however, that the monitoring process 100*b* was, in essence, limited to a "real-time" monitoring system since the primary use of the acquired data was to adjust selected physical parameters which affect the on-going die casting manufacturing process 100*a* to correct for identified deviations of the selected physical parameters from pre-selected values. While the monitoring process 100*b* included plural inspections of the die castings for defects, the monitoring process 100*b* did not provide any method by which identified defects in a die casting could be associated with the physical conditions in place at the time the die casting bearing the identified defects was manufactured. In particular, data acquired after the die castings were manufactured and shipped, for example, a defect first noted after the die casting had been chrome-plated by the supplier, was of little, if any, use in assisting a determination by the manufacturer of the cause of the defect or how to prevent subsequent die castings from developing similar defects. In contrast with the monitoring process 100*b*, the monitoring process 200*b* enables the manufacturer to associate defects, including those defects first noted after a die casting is shipped to a remotely located supplier for further processing, for example, chrome-plating, with the physical conditions under which the die casting bearing the noted defects was manufactured. By doing so, the manufacturer may adjust the physical conditions under which subsequent castings are manufactured to substantially reduce the frequency at which the noted defect occurs.

The monitoring process 200*b* commences at step 222 and, at step 223, a conventionally configured spectrometer is used to analyze the chemical composition of the molten metal or metal alloy, produced at step 202 of the manufacturing process, to be subsequently used to form the die castings. To analyze the molten metal or metal alloy, a spectral analysis is obtained for comparison with a pre-selected baseline spectrum which corresponds to the desired chemical composition. Deviations from the baseline spectrum are indicative that the chemical composition of the molten metal or metal alloy to be used in the die casting process differs from the desired chemical composition thereof. As will be more fully described below, the data acquired during from conducting a spectral analysis of the molten metal or metal alloy is then recorded for subsequent analysis thereof.

After acquiring data regarding the chemical composition of the molten or molten alloy to be used to manufacture the die castings at step 223, the monitoring process 200*a* proceeds to step 224 where the temperature of the molten metal or metal alloy and the extent to which the molten metal or metal alloy was degassed are measured while the molten metal or metal alloy is being held at the secondary furnace. As before, the data acquired from measuring the temperature of the molten metal or metal alloy and the extent to which the molten metal or metal alloy has been degassed are then recorded for subsequent analysis thereof. Proceeding on to step 226, as the die casting machine cycle is executed at step 206 of the manufacturing process 200*a* to form a die casting, plural sensors or other types of electronic devices measure a level for each one of a pre-selected series of physical parameters at the time the die casting is formed. Again, the measured level for each one of the pre-selected series of physical parameters is recorded for subsequent analysis thereof.

It is fully contemplated that, in various embodiments of the invention, the number, type and/or combination of physical parameters selected for inclusion in the aforementioned series of physical parameters may be varied while still remaining within the scope of the present invention. For example, some of the physical parameters suitable for inclusion in the series of physical parameters to be measured each time that a die casting is formed during a die casting machine cycle include die ejector plate temperature, die cover plate temperature, die cavity pressure, die lube ratio, die lube spray volume per shot, die spray pattern, die spray time, shot profile (which, as previously set forth, includes slow shot velocity, fast shot velocity, transition time and intensification pressure), total die casting machine cycle time, vacuum level and hot oil temperature. It should be clearly understood, however, that it is not necessary that all of the aforementioned physical parameters be selected for data acquisition at step 226 during each die casting machine cycle. Rather, it is specifically contemplated that data may be acquired during each die casting machine cycle for any one or combination of more than one of the aforementioned physical parameters. It should be further understood that the foregoing list of physical parameters suitable for data acquisition at step 226 during each die casting machine cycle is purely exemplary and that other physical parameters not specifically recited herein may also be suitable for data acquisition, either alone or in combination with one or more of the aforementioned physical parameters, at step 226 during each die casting machine cycle.

The monitoring process 200*b* then proceeds to step 228 where, after the extracted die casting has been marked at step 208 of the die casting manufacturing process 200*a* with a unique identifier such as a serial number, the unique identifier is recorded for subsequent analysis thereof. Prior to analysis thereof however, a die casting physical parameter record is constructed by placing, in respective fields of a data record, the chemical composition of the molten metal or metal alloy acquired at step 223, the temperature of the molten metal or metal alloy acquired at step 224, the extent of degasification of the molten metal or metal alloy acquired at step 224, the various physical parameters acquired at step 226 and the unique identifier acquired at step 228.

After constructing a die casting physical parameter record for each die casting manufactured by the die casting machine during a die casting machine cycle, the monitoring process 200*b* continues on to step 230 where, upon trimming the extracted casting at step 212 of the die casting manufacturing process 200*a*, the die castings are examined for visible surface defects during a first visual inspection thereof. Any information regarding defects identified during the first visual inspection is recorded and a die casting defect record is constructed for the die casting bearing the identified defect. Generally, the die casting defect record constructed at step 232 of the monitoring process 200*b* would include a first field containing the unique identifier of the die casting identified as having one or more surface defects and one or more additional fields describing the identified defect. For example, the die casting defect record may include fields which contain the number, type and location of the identified defects.

The die casting defect record constructed at step 232 of the monitoring process 200*b* is for the defective die casting then associated with the die casting physical parameter record for that die casting constructed at step 228. These two otherwise disparate data records—specifically, the die casting physical parameter record containing levels for a series of pre-selected physical parameters measured during formation of a die casting and the die casting defect record containing defect information for that die casting—are associated to one another by matching a unique identifier included as part of the die casting physical parameter record to a unique identifier included as part of the die casting defect record.

After discarding any die castings identified as defective at step 230 of the monitoring process 200*b*, the monitoring process 200*b* proceeds to step 232 where, after machining of the die casting is completed at step 214 of the manufacturing process 200*a*, the dimensions of the machined die casting are measured to ensure that the dimensions of the machined die casting matches the intended dimensions thereof (within appropriate pre-selected tolerances therefore). Presuming that the dimensions of the die castings were determined at step 232 to be within the pre-determined tolerances therefore, the die castings would now be considered ready for shipping to the supplier. Conversely, if the dimensions of any of the die castings are determined to be outside the tolerances of the specified dimensions, a die casting defect record containing the identity/value for the dimension out of specification and the unique identifier for the die casting having one or more dimensions out of specification would be constructed. The die casting defect record would then be associated with the die casting physical parameter record containing levels of the series of pre-selected physical parameters measured during the formation of that die casting and acquired during steps 223, 224 and 226 of the monitoring process 200*b*, again by matching a unique identifier included as part of the die casting defect record constructed for the die casting having one or more dimensions out of specification to a unique identifier included as part of the die casting physical parameter record constructed for that die casting. The defective die casting would then be removed from the manufacturing process 200*a* before delivery thereof to the supplier.

Prior to shipping the remaining die castings which passed the first visual inspection at step 230 and the dimensional check at step 232 to the supplier, a sampling of the remaining die castings are selected for testing purposes. For example, one out of every thousand die castings passing the first visual inspection at step 230 and the dimensional check at 232 may be selected for testing at step 234. The tests performed on the selected die castings at step 234 are intended to determine if the selected die castings are likely to be later rejected by the supplier due to defects identified during the second and third visual inspections conducted by the supplier subsequent to the polishing, buffing and plating operations conducted thereby. It is contemplated that a wide variety of tests may be performed on the selected die castings, including destructive tests in which the selected die castings are destroyed during the testing process and/or non-destructive tests in which the selected die castings may be returned to the die casting manufacturing process after the tests are conducted. Destructive tests which may be performed on the selected die castings may include blister and polish/slice tests. In a blister test, the selected die casting is placed in a die casting oven, heated and subsequently examined visually for blisters and other surface deformities. In a polish/slice test, the selected die casting is polished, sliced into sections, polished again and then visually inspected for defects. Non-destructive tests which may be performed on the selected die castings may include a microscopic inspection of the surface of a selected die casting for defects which may adversely affect a subsequent attempt to chrome-plate the selected die casting but which are not visible to the naked eye when inspecting the selected die casting and x-raying a selected die castings for holes formed in the interior of the die casting.

If the testing performed at step 234 indicates that a selected die casting is defective, a die casting defect record is constructed for the die casting noted as being defecting. As before, the constructed die casting defect record would contain, in respective fields thereof, a description of one or more of the number, type and location of the noted defects and the unique identifier for the die casting having the noted defects. The die casting defect record would then be associated with the die casting physical parameter record containing levels of the series of pre-selected physical parameters measured during the formation of that die casting and acquired during steps 223, 224 and 226 of the monitoring process 200*b*, again by matching a unique identifier included as part of the die casting defect record constructed for the die casting having one or more dimensions out of specification to a unique identifier included as part of the die casting physical parameter record constructed for that die casting. The die casting corresponding to the constructed die casting defect record would then be discarded if the defects were noted during a non-destructive test. Finally, if a destructive test performed on a die casting revealed the absence of defects, a die casting defect record indicating the absence of defects in that die casting would be constructed and then associated with the die casting physical parameter record for that die casting.

After testing of the selected die castings is completed at step 234, monitoring of the die casting manufacturing process continues at the supplier's facility. At step 236 of the monitoring process 200*b*, after the castings are buffed and polished at step 218 of the manufacturing process 200*a* in preparation for plating, the die castings are examined for visible defects, for example, pitting, flaking, breakout or dents, during a second visual inspection. For each die casting noted by the supplier as having visible defects, a die casting defect record is constructed by the supplier at step 238. Typically, the die casting defect record will contain the unique identifier for the die casting noted as defective and a description of the identified defects. Depending on the sophistication of the supplier, the description of the identified defects may include one or more of the number, type and location of the identified defects. As the second visual inspection conducted at step 236 is typically performed at a facility remotely located relative to the location where the die casting was manufactured, once constructed, the die casting defect record is transmitted to the facility where the die casting was manufactured. There, the die casting defect record is associated with a die casting physical parameters record for that die casting, again, by matching the unique identifier for the die casting defect record to the unique identifier for the die casting physical parameters record.

Proceeding on to step 240 of the monitoring process 200*b*, a third visual inspection of the die castings for defects is performed, here, after the die castings have been chrome-plated at step 220 of the manufacturing process 200*a*. As before, for each die casting noted by the supplier as having visible defects, for example, pitting, flaking, breakout or dents, a die casting defects record containing the unique identifier for the die casting noted as defective and a description of the identified defects is constructed by the supplier at step 238. Again, the description of the identified defects may include one or more of the number, type and location of the identified defects. Once constructed, the die casting defects record is transmitted to the facility where the die casting was manufactured (step 242). There, the die casting defects record is associated with a die casting physical parameters record for that die casting, again, by matching the unique identifier for the die casting defect record to the unique identifier for the die casting physical parameters record. Of course, if desired, any die casting defect records generated in response to the second visual inspection of the die castings at step 236 and any die casting defect records generated in response to the third visual inspection of the die castings at step 240 may be combined in a single report for transmission to the manufacturing facility. Variously, the die casting defect records may be transmitted in either an electronic or non-electronic medium. The method then ends at step 243.

Figure 3A:
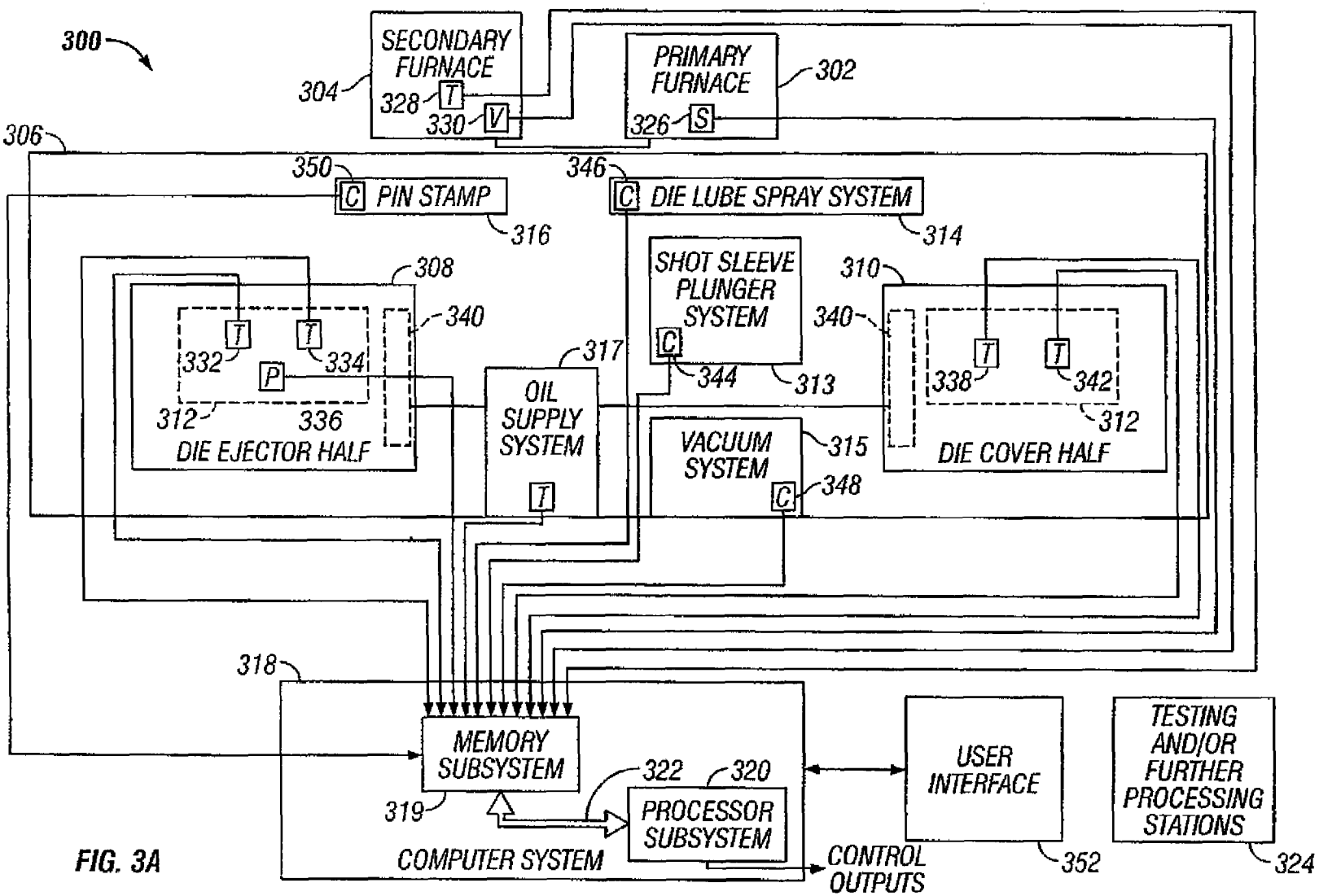
FIG. 3*a* is a block diagram of a system for manufacturing die castings in accordance with the manufacturing and monitoring processes of FIG. 2.

Referring next to FIG. 3*a*, a system for manufacturing die castings constructed in accordance with the teachings of the present invention will now be described in greater detail. It should be clearly understood, however, that the system 300 has been greatly simplified for ease of description and that various conventionally configured components thereof have been omitted from the drawings. As may now be seen, the system 300 for manufacturing die castings is comprised of a primary furnace 302, a secondary furnace 304, an automated die casting cell 306, a computer system 318 and a testing/further processing facility 324. As previously set forth, the primary furnace 302 melts a metal or metal alloy and is coupled to the secondary furnace 304 to enable the transport of the molten metal or metal alloy to the secondary furnace 304. In turn, the secondary furnace holds a lesser amount of the molten metal or metal alloy and is coupled to the automated die casting cell 306 to enable the transport of molten metal or metal alloy to a shot sleeve/plunger system 313 of the automated die casting cell 306. As will be more fully described below, within the automated die casting cell 306, a series of die castings are formed from the molten metal or metal alloy supplied thereto.

The computer system 318 is coupled to the primary furnace 302, the secondary furnace 304 and the automated die casting cell 306. As will be more fully described below, various physical parameters are acquired by sensors and other electronic devices incorporated as part of, or suitably positioned relative to, the primary furnace 302, the secondary furnace 304 and the die casting cell 306. The acquired physical parameters are then stored in the computer system 318. The computer system 318 also includes plural control outputs for controlling the operation of various components of the automated die casting cell 306 and, if desired, the primary furnace 302 and the secondary furnace 304.

Once formed, the die castings are ejected from the automated die casting cell 306 and transported, typically, by a manually controlled transport system, to the testing/further processing station 324. It is contemplated that the testing/further processing station 324 may encompass, among others, a testing facility such as a metallurgical lab located at the same facility housing the automated die casting cell 306, a polish/buffing station located at a facility remotely located relative to the facility housing the automated die casting cell 306 and/or a plating station located at a facility remotely located relative to the facility housing the automated die casting cell 306.

As may be further seen in FIG. 3*a*, the automated die casting cell 306 is comprised of a die having a movable ejector half 308 and a fixed cover half 310, each having an interior side surface which collectively defines a cavity 312, a shot sleeve/plunger system 313, a die lube spray system 314, a vacuum system 315, a pin stamping system 316 and an oil supply system 317. A die cast machine cycle begins with the die lube spray system 314 spraying, in a defined pattern, a pre-determined volume of lubricant along the interior side surfaces of the die ejector and die cover halves 308 and 310 which define the cavity 312. The automated die casting cell 306 then tightly clamps the die ejector and die cover halves 308 and 310 together. The oil supply system 317 begins circulating heated oil through circulation channels 340 formed in both the die ejector and die cover halves 308 and 310 to heat the die ejector and die cover halves 308 and 310 to a desired temperature level. While both the die ejector and die cover halves 308 and 310 would typically include plural circulation channels formed therein, for ease of illustration, only one such channel is illustrated in FIG. 3*a*.

After the die ejector and die cover halves 308 and 310 are heated to the desired temperature level, typically, about 300-400 degrees, the vacuum system 315 applies a vacuum to the cavity 314 to draw the air therefrom. The shot sleeve/plunger system 313 injects molten metal or metal alloy supplied thereto by the secondary furnace 304 into the cavity 312 through one or more passageways (not shown) formed in the die cover half 310. Once injected into the cavity 312, the molten metal or metal alloy is held under pressure for a period of time until solidifying into a die casting. The formed die casting is then ejected from the steel die, thereby completing a die casting machine cycle by the automated die casting cell 306.

Prior to removal from the automated die casting cell 306, however, the pin stamping system 316 marks a unique identifier on the die casting. To mark the die casting, the pin stamping system 316 repeatedly strikes the die casting in a pre-determined pattern to form a series of indentations which collectively form the shape of the unique identifier. As previously set forth, the series of indentations are formed in a selected location not readily visible when the die casting is in use. Of course, a wide variety of other suitable techniques may be used to mark the casting with the unique identifier.

The system 300 further includes plural sensors and other electronic devices which monitor various physical parameters therewithin. Various ones of the sensors and other electronic devices are suitably positioned relative to certain components of the system 300 to measure a physical parameter related to such components. Others of the devices are incorporated within components of the system 300. More specifically, a spectrometer 326 is positioned at a location readily accessible to the primary furnace 302 to determine the chemical composition of the molten metal or metal alloy held thereby. A temperature sensor 328 is suitably positioned relative to the secondary furnace 304 to determine the temperature of the molten metal or metal alloy held thereby. Test apparatus 330 is also located in proximity to the secondary furnace 304. The test apparatus 330 includes a crucible suitable for holding a small sample of the molten metal or metal alloy held by the secondary furnace 304. The test apparatus further includes a vacuum pump which, by drawing the air from the molten metal or metal alloy held in the crucible, can determine the extent to which the molten metal or metal alloy has been degassed.

A number of the aforementioned sensors and other electronic devices are mounted within the die casting cell 306. More specifically, mounted to the ejector half 308 of the steel die are a first temperature sensor 332, a second temperature sensor 334 and a pressure sensor 336. Conversely, mounted to the cover half 310 of the steel die are a third temperature sensor 338 and a fourth temperature sensor 342. The first and second temperature sensors 332 and 334 measure the temperature of the ejector half 308 of the steel die at first and second locations therealong. Preferably, the first and second temperature sensors 332 should be positioned at opposite ends of the ejector half 308 of the steel die along the greater longitudinal dimension thereof. The third and fourth temperature sensors 338 and 342 should be positioned at corresponding locations along the cover half 310 of the steel die. Finally, while mounted to the ejector half 308 of the steel die, the pressure sensor 336 should be suitably positioned to measure the pressure within the cavity 312.

As previously set forth, physical parameters are also acquired from the shot sleeve/plunger system 313, the die lube spray system 314, the vacuum system 315, the pin stamping system 316 and the oil supply system 317. The physical parameters acquired from the shot sleeve/plunger system 313, the die lube spray system 314, the vacuum system 315 and the pin stamping system 316 are all related to the physical forces applied, by the systems 313, 314, 315 and 316 onto either other components of the system 300 or the die casting itself. Thus, the physical parameters related to the sleeve/plunger system 313, the die lube spray system 314, the vacuum system 315 and the pin stamping system 316 may be acquired by the systems themselves.

More specifically, the die casting cell 306 is a fully automated device with robots performing the die lubricant spraying process, the die casting extraction and placement of the extracted die casting into the trim die. By using a fully automated device such as the one disclosed herein, more consistent control over the die casting process is achieved. Further, in such a device, the various systems thereof typically include a controller which, in response to control signals received from the computer system 318, causes the system controlled thereby to perform specified operations. The controllers are also equipped with transducers for measuring the physical forces applied thereby. Thus, as shown in FIG. 3*a*, each of the shot sleeve/plunger system 313, the die lube spray system 314, the vacuum system 315 and the pin stamping system 316 include a controller 344, a controller 346, a controller 348 and a controller 350, respectively, equipped to measure the physical forces applied thereby. In response to control signals received from the computer system 318, the controller 344 of the shot sleeve/plunger system 313 will inject a shot of molten metal or metal alloy into the cavity 312. The controller 344 then measures the parameters of the shot and reports the shot parameters back to the computer system 318.

Similarly, in response to control signals received from the computer system 318, the controller 346 of the die lube spray system 314 will spray a specified volume of lubricant having a specified dilution ratio, flow rate and spray pattern onto the interior side surfaces of the die ejector and cover halves 308 and 310. The controller 346 then reports the spray volume, dilution ratio, flow rate and spray pattern to the computer system 318. In response to control signals from the computer system 318, the controller 348 of the vacuum system 315 will apply a vacuum to the cavity 312 to withdraw air therefrom prior to the injection of molten metal or metal alloy thereinto. The controller 348 then measures the strength of the vacuum applied to the cavity 312 and reports magnitude of the vacuum applied thereto to the computer system 318.

Finally, in response to control signals from the computer system 318, the controller 350 will cause the pin stamper 316 to mark each die casting extracting from the steel die with a unique identifier. The controller will then determine the unique identifier marked on the die casting and report the unique identifier marked on the die casting to the computer system 318. It is contemplated that various techniques may be used for the controller 350 to acquire the unique identifier marked on the die castings. For example, a sensor may be used to count each time a die casting is stamped or otherwise marked with a shot number by the pin stamper 316. Similarly, other components of the unique identifier, for example, date of manufacture or machine number, may be associated with the respective serial number using a variety of techniques. For example, when the serial number of each die casting is recorded in a memory subsystem of the computer system 318, the computer system 318 may be pre-programmed to associate the date and a machine number with each serial number recorded thereby.

As may be further seen in FIG. 3*a*, the computer system 318 is comprised of a memory subsystem 319 and a processor subsystem 320 coupled together by a bus subsystem 322 for bi-directional exchanges of data, address and control signals therebetween. As will be more fully described below, stored in the memory subsystem 319 as die casting physical parameter records are the plural physical parameters and unique identifier acquired, by the system 300 for each die casting manufactured thereby. Also stored in the memory subsystem 310 are die casting defect records acquired by testing and/or visual inspections of the die castings at the testing and/or further processing stations 324 and input the computer system 318 via user interface 352. Finally, as will be more fully described below, also stored in the memory subsystem 319 are plural software applications, executable by the processor subsystem 320. A first one of the plural software applications analyzes the die casting physical parameter and defect records and stores the results of the analysis of the die casting physical parameter and defect records as one or more casting profiles. A second of the software applications modifies operation of the system based upon the analysis of the die casting physical parameter and defect records while a third of the software applications identifies those die castings to be rejected as probable defective die castings before the die castings are shipped to the remote facility for further processing.

Figure 3B:
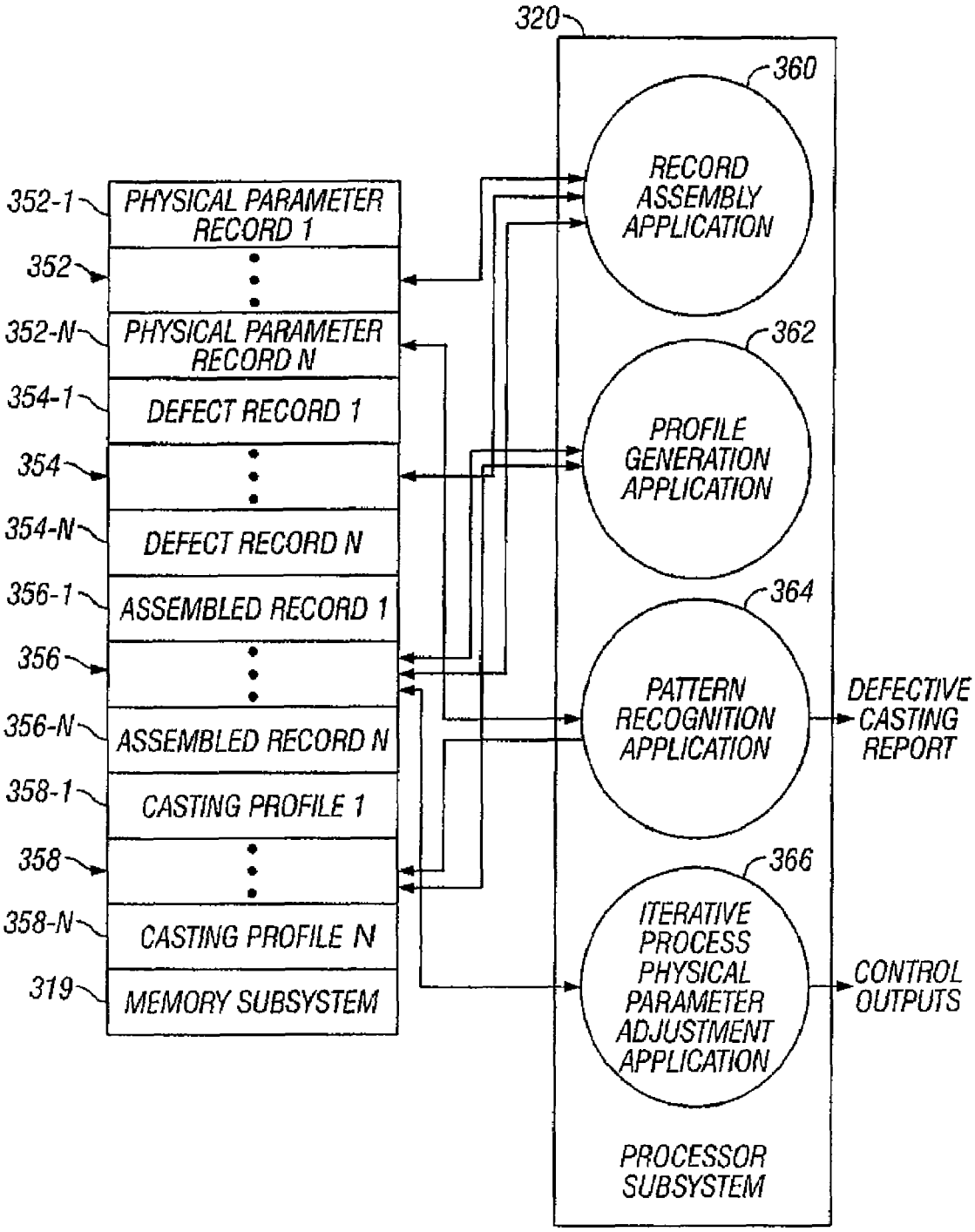
FIG. 3*b* is an expanded block diagram of a computer system portion of the system for manufacturing die castings of FIG. 3*a;*

Referring next to FIG. 3*b*, the computer system 318 will now be described in greater detail. As may now be seen, first, second, third and fourth data spaces 352, 354, 356 and 358 have been defined within the memory subsystem 319. The first data space 352 contains die casting physical parameter records 352-1 through 352-N, each having a first field containing a unique identifier for a die casting formed by the die casting cell 306 and any number of physical parameter fields, each containing a level for a physical parameter measured at the time that the die casting was formed. The second data space 354 contains die casting defect records 354-1 through 354-N, each having a first field containing a unique identifier for a die casting formed by the die casting cell 306 and any number of defect fields describing the number type and/or location of defects noted during an inspection of the die casting. The third data space 356 contains assembled die casting records 356-1 through 356-N, each formed by associating a die casting physical parameter record for a die casting with the die casting defect record for that die casting. Finally, the fourth data space 358 contains casting profiles 358-1 through 358-N, each describing a combination of physical parameters for which die castings formed there under are likely to be defective.

The processor subsystem 320 includes first, second, third and fourth software applications 360, 362, 364 and 366. Each shown in FIG. 3*b* as forming part of the processor subsystem 320, each of the software applications 360, 362, 364 and 366 reside in the memory subsystem 319 and are executable by the processor subsystem 320. As will be more fully described below with respect to FIGS. 4 and 5, the record assembly application 360 constructs the assembled records 356-1 through 356-N by matching unique identifiers forming part of the die casting physical parameter records 352-1 through 352-N to unique identifiers forming part of the die casting defect records 354-1 through 354-N and combining the records containing matching unique identifiers to form the assembled records 356-1 through 356-N. The profile generation application analyzes the assembled die casting records 356-1 through 356-N and stores the results of the analysis of the assembled die casting records as one or more casting profiles 356-1 through 356-N.

As newly acquired die casting physical parameter records are being stored in the first data space 352, the pattern recognition application 356 compares the newly acquired die casting physical parameter records acquired by the system 300 and determines if the die casting manufactured under those conditions is likely to be defective. To make such a determination, the pattern recognition application 364 compares the newly acquired die casting physical parameter record to those die casting profiles maintained in the data space 358 deemed to be unacceptable. If the newly acquired die casting physical parameter record matches an unacceptable die casting maintained in the data space 358, the pattern recognition application 364 will issue a notification that the die casting corresponding to the newly acquired die casting physical parameter record should be discarded. Finally, the iterative process physical parameter adjustment application 366 analyzes the assembled records maintained in the data space 356 and, based upon the analysis of the assembled records, determines if the physical parameters under which die castings are being manufactured should be modified. Upon determining that one or more physical parameters should be adjusted, the iterative process physical parameter adjustment application 366 issues control signals to the appropriate components of the system 300 to adjust the identified physical parameters.

Figure 4:
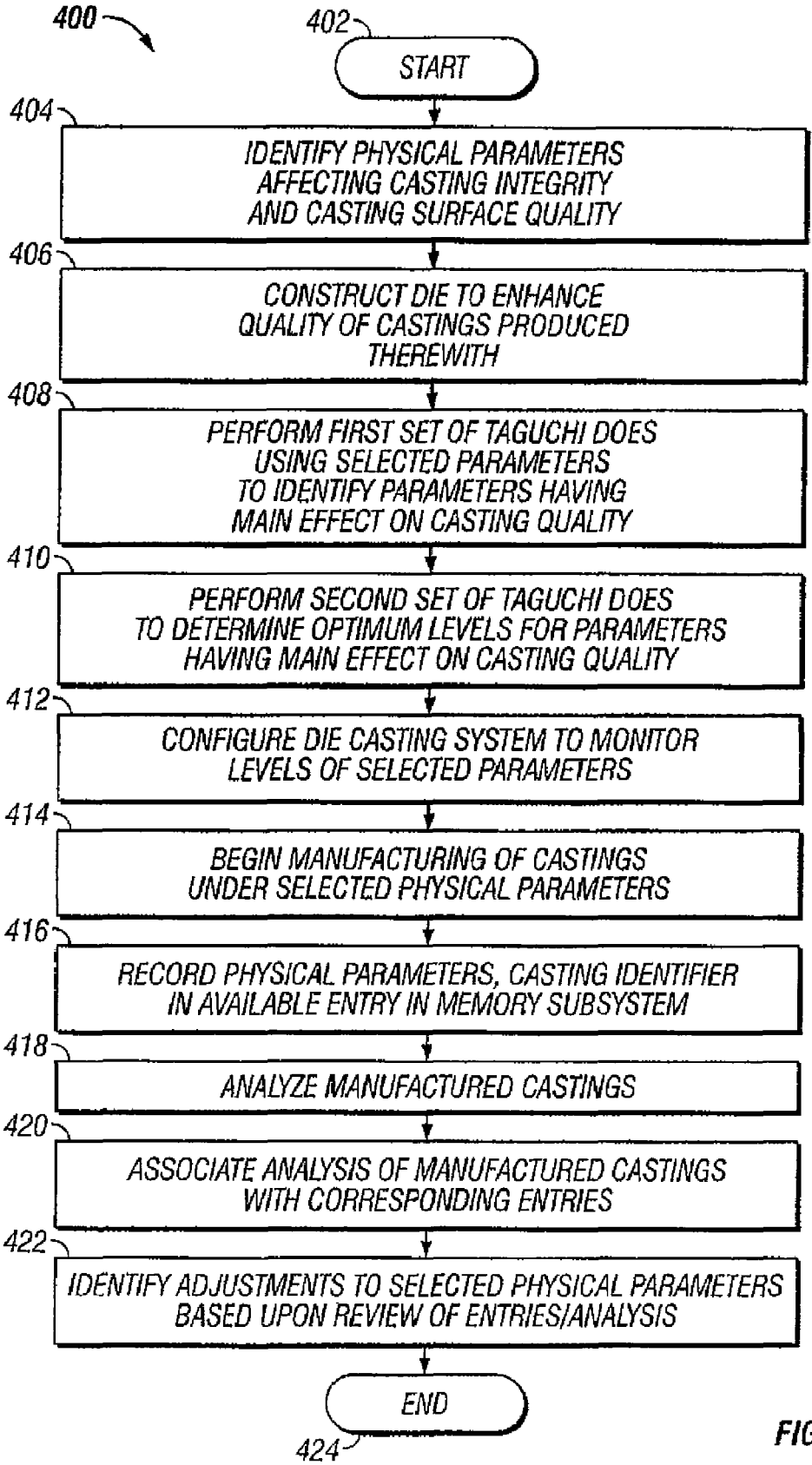
FIG. 4 is a flow chart of a method for manufacturing die castings utilizing iterative process parameter adjustment techniques.
Figure 5:
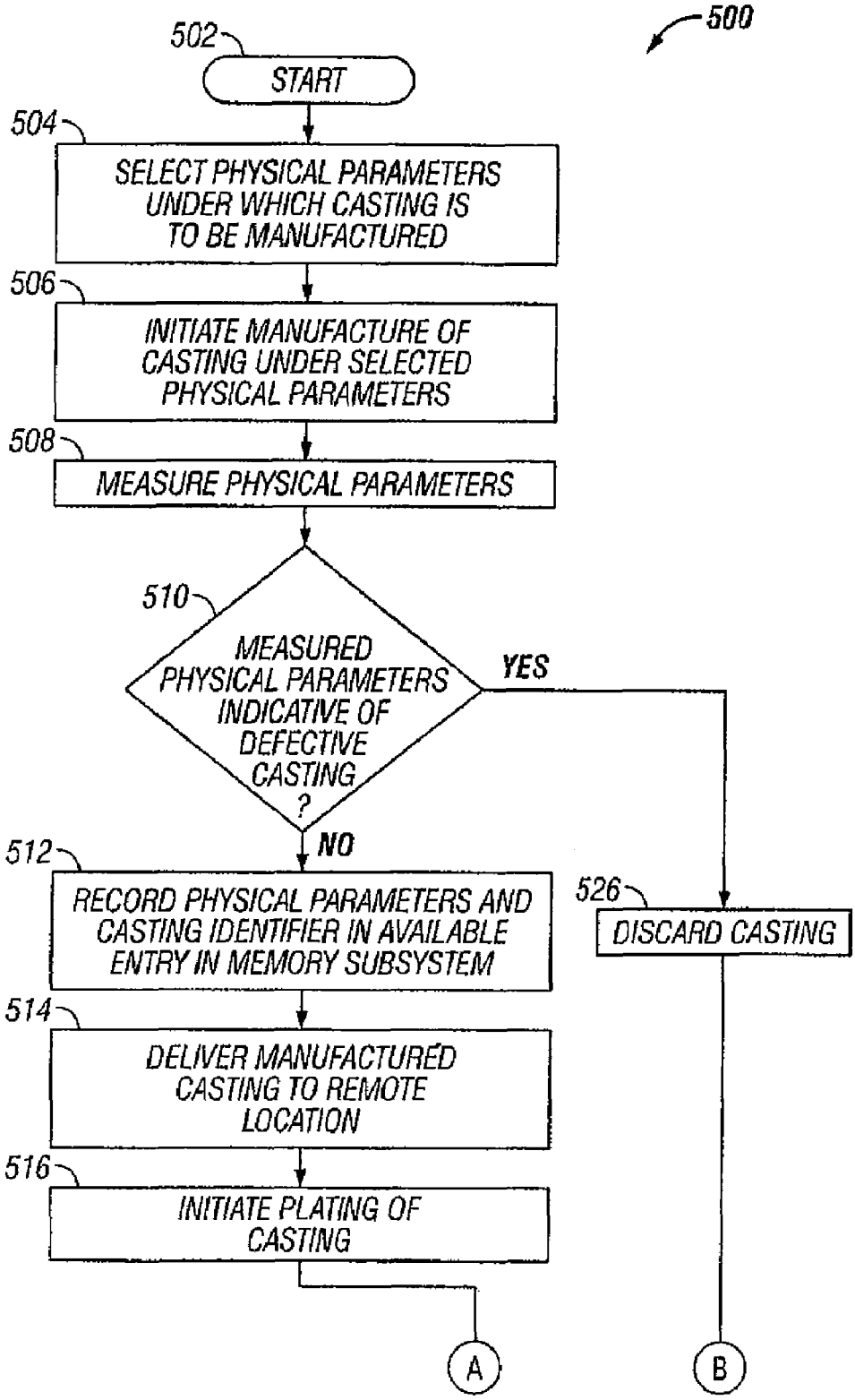
FIG. 5 is a flow chart of a method for manufacturing die castings utilizing computerized pattern recognition techniques.
Figure 5:
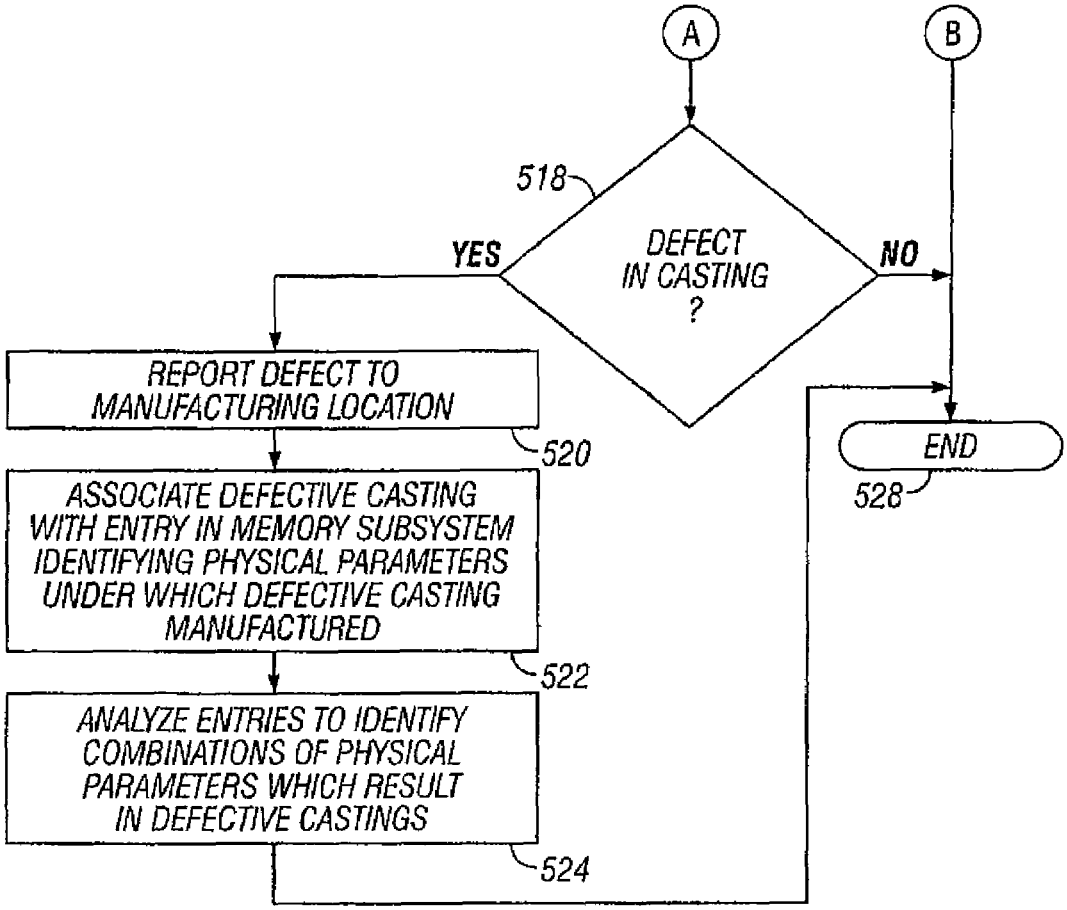

Referring next to FIGS. 4 and 5, methods 400 and 500 of manufacturing die castings, for example, chrome-plated aluminum alloy rocker cover or rocker housing die castings, in accordance with the teachings of the present invention will now be described in greater detail. The methods disclosed herein have proven particularly useful in that they have achieved a dramatic reduction in the rate of rejection of finished die casting products, for example, the percentage of finished chrome-plated aluminum alloy die castings deemed unacceptable for the intended use. Chrome-plated aluminum alloy die casting products, when manufactured using prior die casting techniques, for example, the technique described and illustrated with respect to FIG. 1, suffered from rejection rates upwards of 40%. In sharp contrast therewith, when used to manufacture chrome-plated aluminum alloy die casting products, the methods 400 and 500 described and illustrated with respect to FIG. 4 have enjoyed rejection rate as low as 5%. Furthermore, by continued application of the methods 400 and 500, it is contemplated that rejection rates may be lowered still further than those currently enjoyed.

The method 400 commences at step 402 and, proceeding on to step 404, various physical parameters affecting die casting integrity and die casting surface quality are identified. Physical parameters affecting die casting integrity and surface quality are of primary concern since it is these factors which are generally considered to affect the occurrence of defects in die castings. In the past, the physical parameters which were deemed as affecting die casting integrity and surface quality included metal or metal alloy temperature, die lube spray, fast shot velocity and intensification pressure. For the development of the disclosed processes, the physical parameters deemed as affecting die casting integrity and surface quality were expanded to include die steel chemistry, die steel toughness, die steel hardness, die steel polishing, heat treatment of the die steel, die temperature, alloy cleanliness, alloy gas content, porosity level of the manufactured die castings, vacuum level applied to the die cavity, in-cavity metal pressure, die lube dilution ratio, die lube flow rate, die spray pattern, and amount of plunger lube on a per shot basis.

Continuing onto step 406 a steel die was constructed to enhance the quality of die castings produced therewith. In constructing such a die, those physical parameters deemed as affecting die casting integrity and surface quality and bearing a relation to the construction of the steel die itself were selected from the list of physical parameters set forth above. Thus, from that list, die steel chemistry, die steel toughness, die steel hardness, die steel polishing and heat treatment of the die steel were selected for further consideration. A steel die designed to enhance the quality of die castings produced therewith was then constructed by enhancing one or more of the physical parameters that both affect die casting integrity and surface quality and bear a relation to the steel die itself. For example, while a conventionally configured steel die used in the past to manufacture die castings was constructed using an die steel having a die steel toughness of about 8 ft-lbs and a die steel hardness of between 44 and 46 Rc, was subjected to a heat treatment characterized by a quench rate of 50 degrees Fahrenheit/minute and an austenitizing temperature of about 1,885 degrees Fahrenheit, and, once constructed, was polished using a 220 grit stone. In contrast with prior techniques, a steel die configured in accordance with the teachings of the present invention is constructed using a die steel having a die steel toughness of about 15 ft-lbs and a die steel hardness of between 48 and 50 Rc, is subjected to heat treatment characterized by a quench rate of 110 degrees Fahrenheit/minute and an austenitizing temperature of about 1,990 degrees Fahrenheit, and, once constructed, is polished using a 400 grit stone to achieve a smoother interior side surface thereof.

Once the physical parameters related to the construction of the steel die itself are removed from the list of physical parameters identified at step 404 as affecting die casting integrity and surface quality, the physical parameters to be considered include slow shot velocity, fast shot velocity, intensification pressure, cavity metal pressure, hot oil temperature, die temperature, vacuum level, metal temperature, die spray volume per shot, die spray pattern, die spray time, total cycle time. Proceeding on to step 408, in order to establish the optimum settings for each of the above-listed physical parameters, a series of L4 and L8 Design of Experiments ("DOE") based upon the Taguchi method were performed to determine which of the factors are the main effects which exert the most influence of the plating process and which of the factors have only a minor influence on the plating process. Continuing on to step 410, additional DOEs, again based upon the Taguchi method are performed to determine initial levels for those parameters determined at step 408 as having the main effects on casting quality.

Proceeding on to step 412, a die casting system configured to monitor the levels of the physical parameters determined to have the main effect on die casting integrity and surface quality is constructed and, at step 414, the manufacture of die castings using the determined initial levels of the selected physical parameters is initiated. Typically, once the manufacturing process has been initiated, die castings are manufacture in "lots", each comprised of plural castings manufactured within a specific period of time, for example, a particular day or week.

At step 416 the unique identifier and the selected physical parameters are acquired during the manufacture of each die casting included in the lot and stored in the memory subsystem 319 as respective die casting physical parameter records. At step 418, the die castings manufactured at the initial levels of the selected physical parameters are analyzed for defects in the manner previously set forth and the defect information acquired during the analysis of each die casting of the lot is previously stored in the memory subsystem 319 as a die casting defect record. Typically, the die casting defect records, which are contemplated to include records on each and every acceptable die casting as well as each and every defective die casting are constructed using information acquired at the steps during the manufacturing process previously discussed in great detail.

Proceeding onto step 420, the record assembly application 360 associates die casting physical parameter records with die casting defect to construct die casting assembled records and stores the assembled records in the memory subsystem 319. At step 422, the iterative process parameter adjustment application 366 analyzes the assembled records to determine if adjustments to the initial levels of the selected physical parameters are necessary. It is contemplated that the process parameter adjustment application 366 may use regression analysis or other techniques to identify appropriate adjustments to the levels of the selected physical parameters. Initially, however, the iterative process physical parameter adjustment application 366 should determine the rate of rejection for the current set of assembled records. Next, the iterative process physical parameter adjustment application 366 should determine, based upon an analysis of the various combination of physical parameters which resulted in either defective die castings or acceptable die castings, a modified set of levels for the selected physical parameters which are expected to lower the rate of rejection for the subsequent set of die castings.

It is fully contemplated that the identified physical parameters which may be determined at step 422 as requiring adjustment may include one or more of the physical parameters set forth above, for example, die temperature, cavity pressure, die lube ratio and spray pattern, shot parameters, metal chemistry and metal temperature. It is further contemplated that the one or more of the physical parameters identified as requiring adjustment may be adjusted to various extents, depending on the analysis of the data. Typically, the adjusted setting is selected to be intermediate the high and low settings of those parameters used when performing the aforementioned DOEs using the Taguchi method. Finally, while adjustment of the physical parameters may be performed manually, it is further contemplated that the iterative process physical parameter adjustment application 366 may issue one or more control signals, for example, to the die casting cell 306, which adjusts the specified physical parameters to the specified extent.

After the selected physical parameters are adjusted at step 422, the method 400 returns to step 414 for the manufacture of a subsequent set of die castings using the modified levels for the set of physical parameters. Steps 414, 416, 418, 420 and 422 are then repeated in a series of iterations until a modification of the level of the selected physical parameters does not achieve a reduction in the rejection rate of the die castings manufactured under those conditions. The method then ends at step 424.

Turning now, in greater detail, to FIG. 5, the method 500 commences at step 502 and, at step 504 one or more selected physical parameters to be monitored and the level at which each selected physical parameter is to be maintained is selected. For example, the physical parameters to be monitored and the level at which each selected physical parameter is to be maintained may be selected in accordance with the method 400 illustrated in FIG. 4. Proceeding on to step 506, the manufacture of a lot of die castings with each one of the selected physical parameters to be maintained at a specified level therefore is initiated. During the die casting manufacturing process 200*a*, the level for each one of the selected physical parameters is measured by the system 300, for example using the various sensors and other data collection devices provided for data acquisition.

Continuing on to step 510, if the levels of the selected physical parameters measured at step 508 are deemed to be indicative that a die casting manufactured at the measured levels of the selected physical parameters would likely be defective, the method proceeds to step 526 where the die casting deemed likely to be defective is discarded. The method would then end at step 528. To determine whether the die casting would be determined to be likely be defective, the levels of the selected physical parameters acquired at step 508 are compared to the various casting profiles 358-1 through 358-N maintained in the data space 358 of the memory subsystem 319. If the levels of the selected physical parameters acquired at step 508 matches a defective casting profile maintained in the data space 358, the die casting would be determined to likely be defective and be discarded before being shipped to the remote facility for subsequent polishing and plating operations.

Returning to step 510, if the levels of the selected physical parameters acquired at step 508 does not match a defective casting profile maintained in the data space 358, the method instead proceeds to step 512 where the levels of the selected physical parameters acquired at step 508 and the unique identifier marked on the casting are stored in the data space 352 as a die casting physical parameter record. Having completed manufacture of the die casting, the manufactured die casting, along with the other acceptable die castings of the lot, would be delivered at step 514 to the remote facility. Continuing on to step 516, the plating, for example, the chrome-plating of the delivered die castings is performed. Proceeding on to step 518, if no defects are noted during or subsequent to the plating of the die casting, the method ends at step 528.

If, however, a defect in the die casting is noted at step 518, the method proceeds to step 520 where the noted defect information is reporting to the manufacturing location in the manner previously described. The noted defect information and the unique identifier for the die casting containing the noted defects is then stored in the data space 354 as a die casting defect record. The method then proceeds to step 522 where the die casting defect record is associated with the corresponding die casting physical parameter record, again by matching the unique identifiers of the two records. The associated die casting defect and physical parameter records are then used to construct an assembled record to be stored in the third data space 358. The method then proceeds to step 524 where the assembled records are analyzed by the profile generation application 362 to construct one or more casting profiles to be stored in the data space 358 for identifying defective and/or suitable castings by subsequent comparison at step 510 of the casting profiles to the levels of the selected physical parameters acquired at step 508 for subsequent die castings, again to identify combinations of measured levels of physical parameters deemed likely to result in defective castings.

It should be noted that the remote facility does not provide any defect information regarding die castings determined to be acceptable for use. However, the casting profiles may be constructed to include both acceptable and unacceptable casting profiles by constructing an assembled record for each die casting for which no defects were detected. To construct assembled records for acceptable castings, for each die casting physical parameter record for a die casting defect record having a matching unique identifier cannot be located, a assembled record containing no defect information may be constructed.

Finally, as previously set forth, the profile generation application 362 constructs the casting profiles 358-1 through 358-N by analyzing the assembled records 356-1 through 356-N. While it is preferred that regression techniques and similar advanced data analysis techniques are used to identify casting profiles in which the levels of only a selected subgroup of the larger group of selected physical parameters may be deemed as indicative of either a defective or acceptable casting, in a relatively simple application of the invention, each assembled record for a defective casting may be used as an unacceptable die casting profile and each assembled record for an acceptable casting may be used as an acceptable die casting profile. For the foregoing example, if the measured levels of the selected physical parameters acquired at step 508 measured the levels of the each of the physical parameters in the assembled record, the die casting would be classified as either defective or acceptable at step 510 as appropriate.

Thus, there has been described and illustrated herein, a die casting process which uses pattern recognition techniques to identify those die castings manufactured under conditions likely to produce a die casting which would subsequently prove unacceptable for use. By promptly identifying such die castings, they may be discarded before being shipped to a remote facility for further processing. As a result, the rejection rate of die castings at the remote facility may be reduced. Further, the raw materials used to form the discarded die castings may be more readily recycled. However, those skilled in the art should recognize that numerous modifications and variations may be made in the techniques disclosed herein without departing substantially from the spirit and scope of the invention. Accordingly, the scope of the invention should only be defined by the claims appended hereto.

What is claimed is:

1. A method for manufacturing castings, comprising:

producing a first casting using a die;

ejecting the first casting from the die;

marking a first unique identifier on the first casting subsequent to ejecting the first casting from the die;

producing a second casting using the die without reworking the die subsequent to producing the first casting;

ejecting the second casting from the die; and marking a second unique identifier on the second casting subsequent to ejecting the second casting from the die;

wherein the first casting has the first unique identifier, and the second casting has the second unique identifier which differs from the first unique identifier.

2. The method of claim 1, wherein the first and second unique identifiers are stamped into the corresponding casting.

3. The method of claim 1 further comprising:

analyzing a set of process conditions to determine whether the first casting was produced using a set of casting conditions known to create defective castings; and responsive to a determination that the first casting was produced using the set of casting conditions known to create defective castings, identifying the first casting using the unique identifier and discarding the identified casting.

4. The method of claim 1 further comprising:

selecting a set of conditions for the manufacture of the first casting thereunder; and discarding the first casting if the first casting was manufactured under actual conditions which varied from the selected set of conditions.

5. The method of claim 4, wherein discarding the first casting if the first casting was manufactured under actual conditions which varied from the selected set of conditions further comprises:

constructing a profile for the first casting manufactured under the selected set of conditions;

determining if the profile for the first casting manufactured under the selected set of conditions matches a defective casting profile; and discarding the first casting manufactured under the selected set of conditions for which the profile thereof matches the defective casting profile.

6. The method of claim 5, wherein constructing a profile for the first casting manufactured under the selected set of conditions further comprises measuring an actual level for the physical parameters during the manufacture of the first casting, wherein the profile is comprised of the measured level for the physical parameters during the manufacture of the first casting and the first unique identifier.

7. The method of claim 6, wherein discarding the first casting manufactured under the selected set of conditions for which the profile thereof matches the defective casting profile further comprises identifying the first casting using the unique identifier.

8. The method of claim 6, wherein marking the first unique identifier on the first casting occurs subsequent to ejection of the first casting from the die via stamping.

* * * * *

UNITED STATES PATENT AND TRADEMARK OFFICE

CERTIFICATE OF CORRECTION

PATENT NO. : 7,677,295 B2
APPLICATION NO. : 12/049057
DATED : March 16, 2010
INVENTOR(S) : Anrie Fulton, Yan Zhu and Michael Bomar It is certified that error appears in the above-identified patent and that said Letters Patent is hereby corrected as shown below:

Column 6, Line 61: replace "124 of the monitoring process 10b, as the shot segment of the"
with -- 124 of the monitoring process 100b, as the shot segment of the --

Column 8, line 39: replace "solid metal or metal allow to a temperature above its melting"
with -- solid metal or metal alloy to a temperature above its melting --

Column 13, line 41: replace "structed for the die casting noted as being defecting. As"
with -- structed for the die casting noted as being defective. As --

Column 16, Line 53: replace "casting itself. Thus, the physical parameters related to the"
with -- casting itself. Thus, the physical parameters related to the shot --

Column 18, Lines 26 - 27: replace "physical parameters for which die castings formed there under are likely to be defective."
with -- physical parameters for which die castings formed thereunder are likely to be defective --.

Signed and Sealed this

Twenty-first Day of December, 2010

David J. Kappos

David J. Kappos
*Director of the United States Patent and Trademark Office*